United States Patent [19]

Ibrahim

[11] 4,399,662

[45] Aug. 23, 1983

[54] ISLAND REFRIGERATED DISPLAY CASE WITH AIR DEFROST

[75] Inventor: Fayez F. Ibrahim, Niles, Mich.

[73] Assignee: Tyler Refrigeration Corporation, Niles, Mich.

[21] Appl. No.: 308,147

[22] Filed: Oct. 2, 1981

Related U.S. Application Data

[60] Division of Ser. No. 145,859, May 1, 1980, Pat. No. 4,314,457, which is a continuation-in-part of Ser. No. 107,261, Dec. 26, 1979, Pat. No. 4,265,092, which is a continuation-in-part of Ser. No. 76,669, Sep. 18, 1979, Pat. No. 4,314,453, which is a continuation-in-part of Ser. No. 60,459, Jul. 25, 1979, Pat. No. 4,295,340, which is a continuation-in-part of Ser. No. 11,804, Feb. 14, 1979, abandoned.

[51] Int. Cl.[3] ..... A47F 3/04

[52] U.S. Cl. ..... 62/82; 62/256

[58] Field of Search ..... 62/256, 82, 282

[56] References Cited

U.S. PATENT DOCUMENTS

| | | | |
|---|---|---|---|
| 3,289,432 | 12/1966 | Brennan et al. | 62/256 |
| 4,026,121 | 5/1977 | Aokage et al. | 62/151 |
| 4,120,174 | 10/1978 | Johnston | 62/256 |
| 4,285,204 | 8/1981 | Vana | 62/256 X |
| 4,304,098 | 12/1981 | Rydahl | 62/82 |

*Primary Examiner*—William E. Tapolcai

*Attorney, Agent, or Firm*—LeBlanc, Nolan, Shur & Nies

[57] ABSTRACT

An island refrigerated display case can be constructed so as to in effect constitute to back-to-back display cases that can be arranged as a separate aisle within a supermarket. Such an island refrigerated display case has two interior display spaces separated by a partition wall with each display space having its own access opening so as to enable refrigerated products to be removed from that portion of the case. Encircling each of the interior display spaces is an associated refrigeration air conduit. Each of the refrigeration air conduits has an inlet and outlet opening positioned so as to direct air across the corresponding access opening for the interior display space. Thus during the refrigeration cycle of operation, a refrigerated air curtain is formed between the corresponding outer wall and the center partition wall so as to extend across the associated access opening. The portions of the refrigeration air conduits that extend through the partition wall can be joined so as to form a single chamber. In this manner, the evaporator coils can be located either along each of the refrigeration air conduits or in the central chamber within the partition wall. The island display cases are defrosted by an ambient air defrost system in which ambient air is drawn into and circulated through the refrigeration air conduits for defrosting any frost buildup within such conduits.

20 Claims, 12 Drawing Figures

ISLAND REFRIGERATED DISPLAY CASE WITH AIR DEFROST

RELATED APPLICATIONS

This is a division of application Ser. No. 145,859, filed May 1, 1980, now U.S. Pat. No. 4,314,457, which is a continuation-in-part of the following applications: Ser. No. 011,804, entitled Open Top Refrigerated Display Case, filed Feb. 14, 1979, now abandoned, which is a continuation-in-part of Ser. No. 060,459, entitled Open Top Refrigerated Display Case Having Ambient Air Defrost, filed July 25, 1979, now U.S. Pat. No. 4,295,340; which is a continuation-in-part of Ser. No. 76,669, entitled One and a Half Band Refrigerated Display Case, filed Sept. 18, 1979, now U.S. Pat. No. 4,314,453; which is a continuation-in-part of Ser. No. 107,261, entitled Refrigerated Display Case Having Air Defrost with Supplemental Heater, filed Dec. 26, 1979, now U.S. Pat. No. 4,265,092. Each of the above-identified applications is hereby incorporated by reference.

BACKGROUND OF THE INVENTION

The present invention relates to island type refrigerated display cases having an ambient air defrost system. Such island display cases are constructed as open top cases, although a plurality of shelves for unrefrigerated products can be mounted above the central portion of the case. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

Island type refrigerated display cases have been utilized for many years in the design of supermarkets. Such cases are typically used as open top freezer cases. The island cases have the general appearence of two cases arranged back-to-back that can share a partial common air conduit with a single set of fans for circulating air through such conduit. An example of a back-to-back open front roll in case is illustrated in U.S. Pat. No. 3,392,543 to Miller. A prior art open top island display operated case in an ambient air defrost cycle is shown in FIG. 12.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves total reliance on the use of electric resistance heaters that are arranged adjacent to the refrigerated coils of the refrigeration mechanism. During a defrost cycle, these heaters supply heat in an effort to eliminate the frost buildup on the coils. The particular technique is relatively simple both in its construction and operation. However, since the electrical heaters are high voltage heaters that utilize significant electricity during operation, with the rapidly increasing cost of electricity it has become extremely uneconomical to employ such systems as the primary and sole source of heat for defrosting the coils.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt any frost buildup that has accumulated on the refrigeration coils but simultaneously provides heat within the air conduit which can be circulated through the display case, which is disadvantageous. While this type of system does not suffer from the high cost of operation of the electrical heater defrost system, the heated gas system involves a relatively high construction cost. Due to the requirement that the system be able to selectively switch between the supply of heated gas and refrigerant to the refrigeration coils, a complicated valving structure must be provided. Such a mechanism significantly increases the cost of construction of the display case. In addition, the provision of such a complicated system only increases the number of complex parts capable of breaking down and necessitating costly repairs.

The third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,404,525; 3,850,003 and 3,937,033, all to Beckwith, et al. Each of these systems uses fans separate from the main air circulating fans. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. '003 patent indicates that the concepts described in U.S. Pat. Nos. 3,082,612 and 3,403,525 did not prove to be practical and hence were not commercially feasible.

Finally, a third type of ambient air defrosting system is shown in U.S. Pat. No. 4,144,720 to Subera, et al., which is assigned to the same assignee as the present application. In the foregoing patent, an open front refrigerated display case having primary and secondary air conduits is disclosed. In this system, reversible fans are employed for reversing the direction of flow of air within the conduits and simultaneously drawing in air from outside of the display case.

Another system employing reversible fans for ambient air defrost is shown in U.S. Pat. No. 4,026,121. This patent, however, refers to short-circuiting the air flow between the primary and secondary air bands for the purpose of supplying warmer air to the primary band.

It has been recognized that an ambient air defrost operation can be incorporated into an open top refrigerated display case as disclosed in U.S. Pat. No. 4,120,174 to Johnson. The Johnson patent illustrates an open top case having a single air conduit extending around the case. During the refrigeration cycle, the air flows in a first direction and during the defrost cycle the direction of the air flow is reversed with ambient air being drawn into the conduit. The quantity of air flow during the defrost cycle is greater than during refrigeration.

SUMMARY OF THE INVENTION

An object of the present invention is to provide an island refrigerated display case utilizing an ambient air defrost operation.

Another object of the present invention is to provide an improved island refrigerated display case in which a secondary protective air screen can be provided across each of the access openings without the requirement of a separate set of fans.

A further object of the present invention is to provide an improved island refrigerated display case in which additional ambient air can be drawn into the refrigeration air conduit surrounding each of the interior display spaces in the case for assisting in the defrosting of the evaporator coils without any requirement for an additional set of fans.

An additional object of the present invention is to provide an improved island refrigerated display case in which a refrigerated primary air band and a secondary air band encircle each of the interior display spaces during a refrigeration cycle of operation and ambient air is drawn into and passes through the refrigeration air conduit during a defrost cycle of operation.

Still another object of the present invention is to provide an island refrigerated display case having a primary refrigeration air conduit encircling each of the interior display spaces in the case and at least a partial secondary air conduit surrounding each refrigeration air conduit and where during a defrost operation ambient air passes through both air conduits and the ambient air passing through the secondary conduit transfers heat to the air passing through the associated refrigeration air conduit by convection and conduction.

Still a further object of the present invention is to provide a one and a half band island refrigerated display case utilizing an ambient air defrost operation.

A still further object of the present invention is to provide a multi-band island refrigerated display case utilizing an ambient air defrost operation.

These objectives can be achieved by the utilization of an island refrigerated display case that is defrosted by an ambient air defrost operation. The island refrigerated display case is formed in a cabinet having two interior display spaces with two access openings in the top of the case, each opening being associated with one of the display spaces. The access openings enable access to refrigerated products within each of the interior display spaces. A first refrigeration air conduit extends along one of the outer walls, the bottom wall and the partition wall that separates the two interior display spaces so as to extend around a first of the interior display spaces. A similar second refrigeration air conduit extends along the appropriate walls so as to encircle the second interior display space. Each of the refrigeration air conduits has an air inlet opening at one end of the associated access opening and an air outlet opening at the other end of the associated access opening. The inlet and outlet openings are aligned so that air leaving the outlet opening is directed across the access opening and received by the inlet opening so as to establish a refrigerated air curtain across the access opening. The normal pattern of air flow across the access opening during a refrigeration cycle of operation is for the air to flow from the outer walls towards the center partition wall although a refrigerated air flow in the opposite direction can be utilized. A set of fans circulates air through the first and second refrigeration air conduits. Normally a separate set of fans is arranged within each of the conduits for circulating such air. A refrigeration mechanism that includes a set of evaporator coils refrigerates the air passing through the refrigeration air conduits during a refrigeration cycle of operation. A control mechanism serves to switch the display case between a refrigeration cycle of operation and a defrost cycle of operation. During the defrost cycle of operation, the operation of the refrigeration mechanism is temporarily terminated and ambient air is drawn into and flows through the refrigeration air conduits for defrosting any frost buildup within such conduits, such frost buildup primarily occurring on the evaporator coils of the refrigeration mechanism.

The island refrigerated display cases of the present invention can be constructed as single band cases, one and a half band cases or multiple band cases. In each situation, the number of bands refers to the number of conduits encircling each of the interior display spaces. Thus, it is possible to construct the cases utilizing only a refrigeration air conduit surrounding each of the interior display spaces; such an arrangement is a type that has been commonly utilized in constructing those island refrigerated display cases commonly marketed today. In addition to the use of a refrigeration air conduit encircling each of the interior display spaces, it is also possible to employ a partial secondary or a full secondary air conduit encircling each of the interior display spaces.

The use of a secondary air conduit serves to create a secondary air curtain across the associated access opening. Such secondary air curtain lies outside of the refrigerated air curtain and acts to protect the refrigerated air curtain. For this purpose, each of the secondary air conduits has an outlet opening for directing air across the associated access opening. If a full secondary air conduit is utilized, then each conduit also has an inlet opening arranged at the opposite end of the access opening for receiving the air flowing along the secondary air curtain across the access opening.

Air is circulated through the refrigeration air conduits by a set of fans. An additional separate set of fans are employed where complete secondary air conduits extend around each of the refrigeration air conduits.

The number of fans used in association with each air conduit depends on the lateral length of the conduit and the sizes of the fans. Typically two fans are used for an eight foot long case and three fans for a twelve foot long case.

The air is circulated through each of the refrigeration air conduits and the associated secondary air conduits in the same forward directions during a refrigeration cycle of operation so that air is expelled from the appropriate outlet openings and travels across the access opening and then returns to the appropriate air conduit through the corresponding inlet openings. During a defrost cycle of operation, the air can be circulated through the refrigeration air conduits in a reverse direction so that air is expelled from the inlet openings and ambient air is drawn into the refrigeration air conduits through the outlet openings. Such an air flow pattern is utilized both in the single and one and a half band refrigerated cases.

In the multi-band island refrigerated display cases, it is alternatively possible to continue the direction of flow of air through the refrigeration air conduits while reversing the direction of flow of air through the secondary air conduits. Ambient air is then drawn into the secondary air conduits through their outlet openings and such air is then diverted into the flow of air through the refrigeration air conduits at a location upstream of, i.e. before, the evaporator coils within the refrigeration air conduit. Alternatively, the air flow through both the refrigeration air conduit and the associated secondary air conduit can be reversed with ambient air being drawn into both air conduits through their respective outlet openings.

A pattern of air flow can be chosen so that during the refrigeration cycle of operation the air lows through the refrigeration air conduit so as to flow form the partition wall towards the outer wall across the associated access opening. With such an arrangement, when the air flow pattern is reversed during the defrost cycle of operation, the air is expelled through the opening in the outer walls. The air conduits in the location of the outer walls can be constructed so that when the air is expelled during the defrost cycle of operation such air is directed along a path up and away from the display case.

In constructing the island refrigerated display cases, it is possible to join the refrigeration air conduits into a single chamber in the area of the partition wall providing that there are no secondary air conduits arranged within the partition wall. If there are secondary air conduits extending through the partition wall then instead of using a single chamber for the refrigeration air conduits, a single chamber can be formed for the secondary air conduits. By utilizing such alternative embodiments, it is possible to use a single set of fans for either the refrigeration air conduits or the secondary air conduits with such fans being arranged within the single chamber in the partition wall. In addition, if a single chamber is used in the partition wall for the refrigeration air conduits it is further possible to arrange the evaporator coils within such single chamber. Such arrangements serve to decrease the number of parts needed for constructing the island display cases thereby reducing the cost of such cases.

Both in the one and a half band and multi-band island refrigerated display cases, the relative sizes of the refrigeration air conduits and the associated secondary air conduits can be appropriately adjusted so as to obtain the optimum desirable air flow during the operation of such display cases. This is particularly important in the operation of the one and a half band display cases.

The air flow through the refrigeration air conduits is partially restricted due to the existence of the evaporator coils within such conduit. Such restriction or resistance to the air flow exists even if there is no frost buildup on the evaporator coils. Thus, with the one and a half band display cases, if the refrigeration and partial secondary air conduits both have the same cross-sectional dimensions there would be a natural tendency for the air to flow in greater quantity through the secondary air conduit than the refrigeration air conduit during a refrigeration cycle of operation. In order to prevent this natural tendency and to provide a better balance of the air flow between the conduits, the first air conduit is provided with a greater cross-sectional area. In accordance with one preferred embodiment of the present invention, the cross-sectional area of the refrigeration air conduit is three square feet while the cross-sectional area of the secondary air conduit is two square feet. In order to provide additional resistance to the air flow through the secondary air conduit, a screen with a plurality of perforations can be provided within the secondary air conduit.

The refrigeration and secondary air conduits are constructed so that the volume of air flowing through the secondary air conduit during at least a portion of the defrost cycle of operation is greater than the volume of air flowing through the secondary air conduit during a refrigeration cycle of operation. In this manner, a greater quantity of ambient air passes through the air conduits than would otherwise be possible. It must be taken into consideration that at the start-up of the defrost cycle of operation the accumulation of frost on the evaporator coils significantly restricts the air flow through the refrigeration air conduit thereby causing the volume of such air flow to be extremely diminished. During the refrigeration cycle of operation, the volume of air flowing through the secondary air conduit should be approximately one-third of the volume of air flowing through the refrigeration air conduit. During the defrost cycle of operation, on the other hand, the volume of air flowing through the secondary air conduit should be at least one-half of the volume of air flowing through the refrigeration air conduit.

DESCRIPTION OF THE PREFERRED EMBODIMENTS

Figure 1:
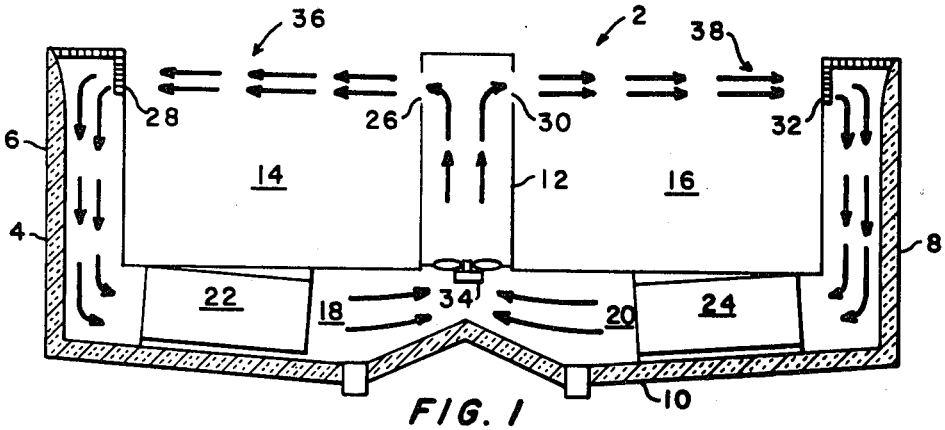
FIG. 1 is a cross-sectional view of a single band island refrigerated display case during a refrigeration cycle of operation.

A single band open top island refrigerated display case 2 is illustrated in FIG. 1. Display case 2 is formed within cabinet 4 with opposing side walls 6 and 8 and bottom wall 10. A partition wall 12 separates the two interior display spaces 14 and 16 of display case 2. Encircling each of the interior display spaces, 14 and 16, is an associated air conduit, 18 and 20, respectively. Arranged within refrigeration air conduit 18 is a set of evaporator coils 22 and similarly arranged within air conduit 20 is a set of evaporator coils 24.

Air conduit 18 has an air outlet opening 26 arranged within the partition wall and at its opposite end an air inlet opening 28 which is arranged in the appropriate outside wall. As air is circulated through air conduit 18 during a refrigeration cycle of operation, such as illustrated in FIG. 1, the air is emitted from outlet opening 26 directed across access opening 36 of interior display space 14 and received back into the air conduit through inlet opening 28. In this manner a curtain of refrigerated air is formed across access opening 36. Similarly, air conduit 20 has an outlet opening 30 in partition wall 12 and an inlet opening 32 in side wall 8. As air is circulated through conduit 20 during a refrigeration cycle of operation, the air is emitted from outlet opening 30 directed across access opening 38 and received back into the conduit through inlet opening 32. In this manner, a curtain of refrigerated air is established across access opening 38.

In order to circulate the air through air conduits 18 and 20 either separate sets of fans for each conduit can be utilized or a single set of fans such as represented by fan 34 can be employed. A single set of common fans for circulating air through both conduits, such as represented by fan 34, only can be employed if both conduits are joined together within the partition wall so as to form a single chamber such as shown in FIG. 1. If the two refrigeration air conduits, 18 and 20, are maintained separately within partiion wall 12 then separate sets of fans must be employed for circulating air through each conduit.

Figure 2:
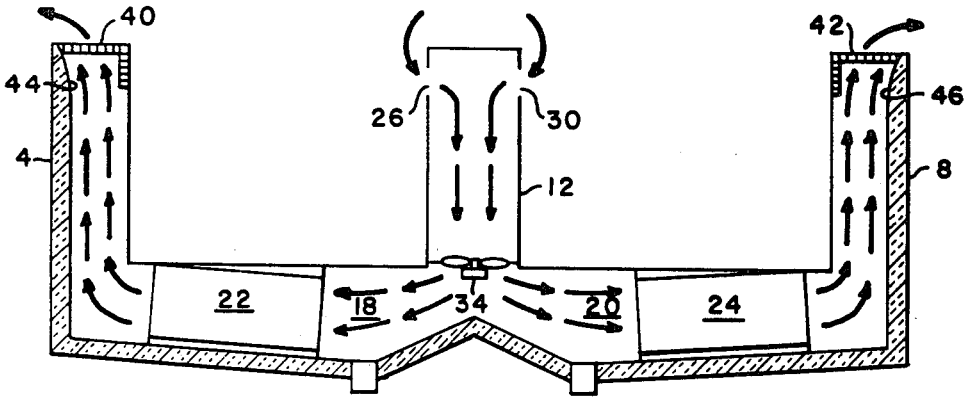
FIG. 2 is another view of the display case of FIG. 1 except it is shown during the defrost cycle of operation.

While during a refrigeration cycle of operation, air is circulated in one direction through each of the air conduits, as shown in FIG. 1, during a defrost cycle of operation, the direction of air flow is reversed, such as represented by the arrows in FIG. 2. This is accomplished by reversing the direction of operation of fan 34. The quantity of air flow during the defrost cycle generally is less than the air flow during the refrigeration cycle of operation. When the air flow patterns as shown in FIGS. 1 and 2 are utilized, then during the defrost cycle of operation ambient air is drawn into the partition wall through outlet openings 26 and 30, circulated through conduits 18 and 20 and evaporator coils 22 and 24, and then expelled through the upper portions 40 and 42 of inlet air openings 28 and 32. In expelling the air through the upper portions of the inlet openings, 40 and 42, it is desirable to direct the air up and away from the display case. For this purpose, inner portions 44 and 46 of side walls 6 and 8 respectively, are sloped outwardly. As the air flows through the air conduits, it tends to assume a path curving along inner wall portions 44 and 46 thereby directing the air up and away from the display case such as shown by the arrows in FIG. 2.

Figure 3:
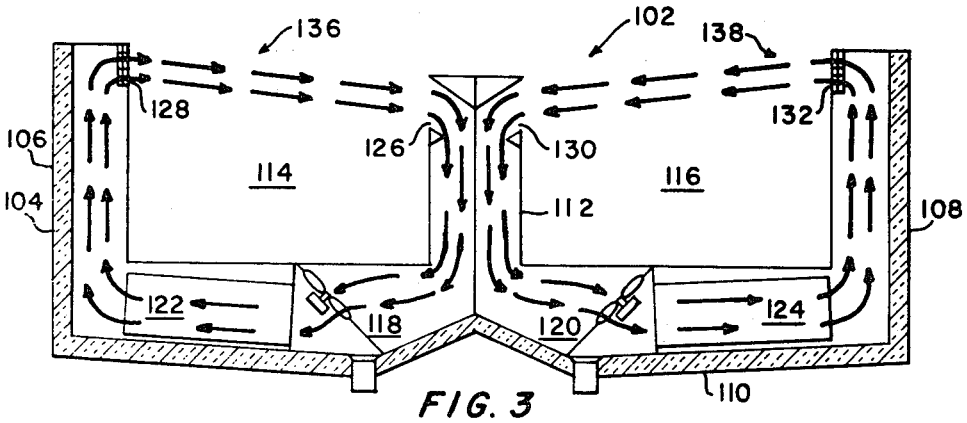
FIG. 3 is a cross-sectional view of another embodiment of a single band island display case during a refrigeration cycle of operation.

A modified single band open top island refrigerated display case 102 is illustrated in FIG. 3. Display case 102 is formed within cabinet 104 with opposing side walls 106 and 108 and bottom wall 110. A partition wall 112 separates the two interior display spaces 114 and 116 of display case 102. Encircling each of the interior display spaces, 114 and 116, is an associated air conduit, 118 and 120, respectively. Arranged within refrigeration air conduit 118 is a set of evaporator coils 122 and similarly arranged within air conduit 120 is a set of evaporator coils 124.

Air conduit 118 has an air outlet opening 128 arranged within the outside wall and at its opposite end an air inlet opening 126 which is arranged in the partition wall. As air is circulated through air conduit 118 during a refrigeration cycle of operation, such as illustrated in FIG. 3, the air is emitted from outlet opening 128 directed across access opening 136 of interior display space 114 and received back into the air conduit through inlet opening 126. In this manner a curtain of refrigerated air is formed across access opening 136. Similarly, air conduit 120 has an outlet opening 132 in outer wall 108 and an inlet opening 130 in partition wall 112. As air is circulated through conduit 120 during a refrigeration cycle of operation, the air is emitted from outlet opening 132 directed across access opening 138 and received back into the conduit through inlet opening 130. In this manner, a curtain of refrigerated air is established across access opening 138.

In order to circulate the air through air conduits 118 and 120 either separate sets of fans for each conduit can be utilized such as represented by fans **134*a* and 134*b* or a single set of fans can be employed. A single set of common fans for circulating air through both conduits can be employed if both conduits are joined together within the partition wall so as to form a single chamber. If the two refrigeration air conduits, 118 and 120, are maintained separately within partition wall 112 then separate sets of fans must be employed for circulating air through each conduit, such as shown in FIG. 3**.

Figure 4:
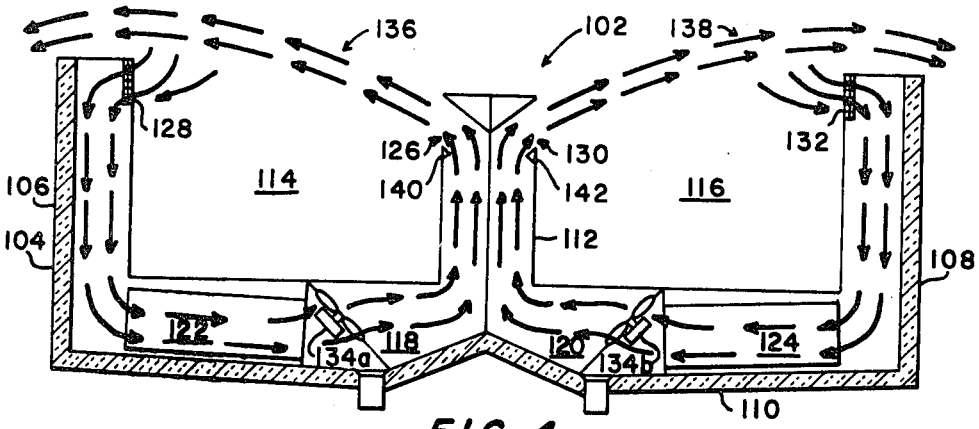
FIG. 4 is another view of the display case of FIG. 3 except it is shown during a defrost cycle of operation.

While during a refrigeration cycle of operation, air is circulated in one direction through each of the air conduits, as shown in FIG. 3, during a defrost cycle of operation, the direction of air flow is reversed, such as represented by the arrows in FIG. 4. This is accomplished by reversing the direction of operation of fans **134*a* and 134*b*. The quantity of air flow during the defrost cycle generally is less than the air flow during the refrigeration cycle of operation. When the air flow pattern as shown in FIG. 4 is utilized, then during the defrost cycle of operation ambient air is drawn into the outer walls through outlet openings 128 and 132, circulated through conduits 118 and 120 and evaporator coils 122 and 124, and then expelled through the inlet air openings 126 and 130. In expelling the air through the inlet openings, 126 and 130**, it is desirable to direct the air up and away from the display case so that the air travels over the outer walls.

In order for the expelled ambient air to pass over the display case and over the associated outer wall, the air must be propelled with sufficient momentum and at an appropriate angle. The portion of the walls of the conduit at the inlet openings are sloped with an angle of approximately 45° so that the emitted ambient air assumes a proper flow path. Under certain aerodynamic conditions, it may be necessary to increase the speed of the emitted ambient air flow in order to ensure that such air travels over the outer wall. Ideally, for a display case having an access opening 51½ inches wide the speed of the air should be a minimum of 150 feet per minute. If the quantity of air (Q) remains the same but the area (A) through which it passes is decreased then the speed (V) of the air must increase. The relationship is as follows $Q=AV$. Consequently if the speed of the air flow needs to be increased, the cross-sectional area of the conduit can be reduced in size by restricting the conduit. Restricting members 140 and 142 reduce the cross-sectional area of the conduits and hence cause the air flow through such area to increase.

Figure 5:
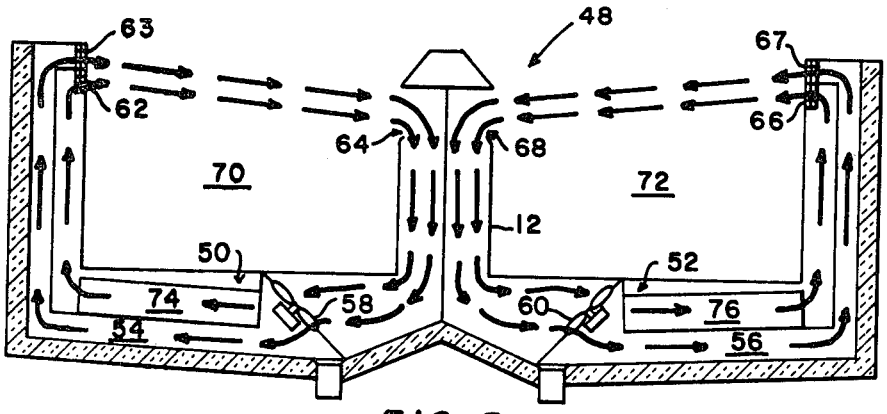
FIG. 5 is a cross-sectional view of a one and a half band island refrigerated display case during a refrigeration cycle of operation.
Figure 6:
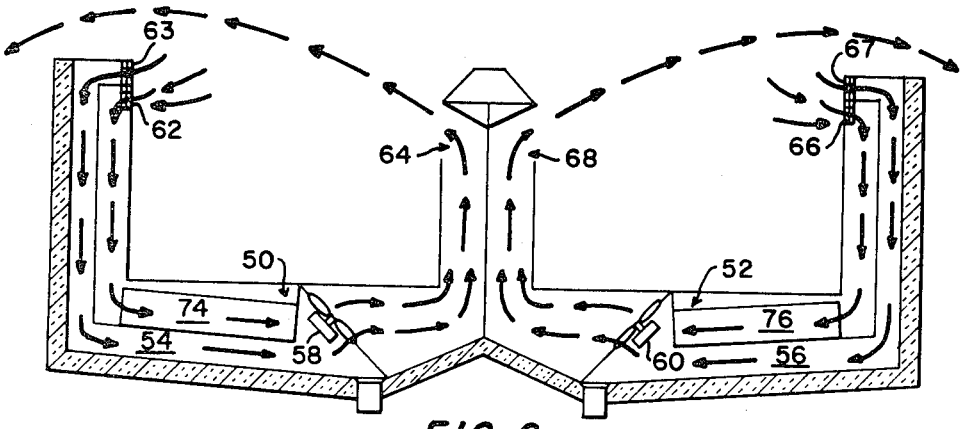
FIG. 6 is another view similar to FIG. 5 except that the display case is operated in a defrost cycle of operation.

A one and a half band island refrigerated display case 48 is illustrated in FIGS. 5 and 6 in its refrigeration cycle of operation and defrost cycle of operation, respectively. Display case 48 is formed within a cabinet similar to cabinet 4 as shown in FIG. 1. The display case has two refrigeration air conduits 50 and 52 each of which extend entirely around a corresponding interior display space 70 and 72, respectively. In addition, extending partially around and outside of refrigeration air conduit 50 is a partial secondary air conduit 54. Similarly a partial secondary air conduit 56 extends partially around refrigeration air conduit 52. A set of fans 58 are arranged within air conduit 50 for circulating air through both refrigeration air conduit 50 and secondary air conduit 54. Another set of fans 60 are arranged within air conduit 52 for circulating air through refrigeration air conduit 52 and secondary air conduit 56. If the portions of air conduits 50 and 52 are joined together so as to form a single chamber in partition wall 12 then a single set of fans can be utilized for circulating air through all of the air conduit, such as discussed above in connection with the embodiments illustrated in FIGS. 1 and 2.

Refrigeration air conduit 50 has an air inlet opening 64 and an air outlet opening 62. Outlet opening 62 and inlet opening 64 are arranged in alignment so that air emitted from outlet opening 62 is directed across the access opening and received back into the conduit through inlet opening 64. Similarly refrigeration air conduit 52 has an inlet opening 68 and an outlet opening 66. Opening 66 and 68 also are arranged in alignment so that air emitted from outlet opening 66 is directed across the access opening and received back into the conduit through inlet opening 68. In this manner, refrigerated air curtains are established across the access openings that lead into interior display spaces 70 and 72.

As air is circulated through refrigeration air conduits 50 and 52, the air passes through a set of evaporator coils, 74 and 76, respectively, arranged within each conduit. The evaporator coils refrigerate the air circulated through the respective conduit during the refrigeration cycle of operation.

Partial secondary conduit 54 receives air circulated by fans 58. Conduit 54 has an inlet opening that opens up into refrigeration conduit 50 so as to receive air that has not passed completely through evaporator coil 74. Thus, the air received by secondary air conduit 54 can enter the conduit before it has passed at all through the evaporator coil or after it has passed through only a small portion of the evaporator coil. Air conduit 54 has an outlet opening 63 that is arranged so as to direct air across the access opening for forming a secondary air curtain that lies outside of the refrigerated air curtain. This secondary air curtain helps to protect the refrigerated air curtain from ambient air outside of the display case. The air flowing along the secondary air curtain is received by refrigeration air conduit 50 through its inlet opening 64. Similarly secondary air conduit 56 receives air circulated by fan 60 and emits such air through an opening 67 along a path across the access opening so as to form a secondary air curtain across the access opening.

By passing a portion of the air entering the secondary air conduit through a portion of the evaporator coils a temperature gradient in the secondary air flow is established. Such a gradient in the temperature means that the inner portion of the secondary flow is cooler than the outer portion. This in effect creates a plurality of layers of air of different temperatures which helps to further protect the refrigerated air curtain. The gradient would normally be on the order of 10° F.

During the refrigeration cycle of operation of the one and a half band refrigerated display case 48 the air flow pattern is shown by the arrows illustrated in FIG. 5. During such refrigeration cycle a band of refrigerated air is circulated around each of the interior display spaces and a partial band of non-refrigerated air is circulated along a path lying outside of the refrigeration air band so as to also encircle the interior display space. While the secondary air band is not refrigerated, it is still partially cooled both due to the partial mixing that occurs between the time that the air enters the inlet opening of the refrigeration air conduit and passes through the circulating fan and in addition to the existence of the common wall between the refrigeration air conduit and partial secondary air conduit.

During a defrost cycle of operation, the direction of operation of fans 58 and 60 is reversed so that air is circulated through each of the air conduits in the opposite direction such as shown by the arrows in FIG. 6. During such operation, the evaporator coils are temporarily deactivated and ambient air is circulated through the air conduits for defrosting any frost buildup within such conduits and particularly the frost buildup on the evaporator coils.

Consequently, as shown in FIG. 6, ambient air is drawn into conduits 50 and 54 through outlet opening 62 and 63 respectively, and then circulated through such conduits. Similarly ambient air is drawn into conduits 52 and 56 through outlet openings 66 and 67, respectively, for circulating such air through the conduits. The ambient air passing along the refrigeration air conduits and hence directly through the evaporator coils serves to defrost the frost buildup on those coils. In addition, the ambient air drawn into the secondary air conduits also transmits heat to the air flowing through the refrigeration air conduits both by conduction through the common walls of the associated conduits and by convection when the ambient air flowing through the secondary conduit mixes with the air flowing through the refrigeration air conduit in the area of the fans. The air flowing through the conduits during the defrost cycle of operation is then emitted from the conduits through the respective inlet openings 64 and 68. The air should be emitted so as to hopefully flow in a substantially upward direction along a path over the opposite wall of the display case as shown by the arrows in the figure.

Figure 7:
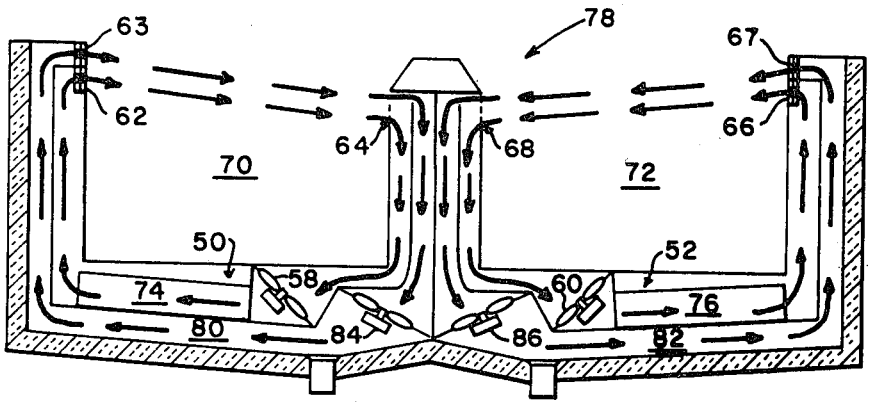
FIG. 7 is a cross-sectional view of a multi-band island refrigerated display case during a refrigeration cycle of operation.

A multi-band open top island refrigerated display case 78 is illustrated in FIG. 7. With respect to many of the elements included in display case 78, these elements are identical to those in the one and a half band refrigerated display case 48 such as illustrated in FIG. 5. Those elements that are the same are identified by the same reference numeral. The primary distinction between display case 78 and display case 48 is the fact that the secondary air conduits extend entirely around the interior display spaces 70 and 72. Thus as shown in FIG. 7, secondary air conduit 80 extends entirely around interior display space 70 and likewise refrigeration air conduit 50. Similarly secondary air conduit 82 extends entirely around refrigeration air conduit 52 and interior display space 72. For this reason, there also is a need for a separate set of fans for circulating air through each of the secondary air conduits. Thus, within secondary air conduit 80 there are a set of fans as represented by fan 84 for circulating air through the conduit. Fan 84 circulates the air through secondary air conduit 80 so that the air is expelled through outlet opening 63, directed across the access opening and reenters the conduit through inlet opening 64 such as shown in FIG. 7. Similarly, a set of fans as represented by fan 86 circulates air through secondary air conduit 82 so as to emit air from outlet opening 67 across the access opening and back into the conduit through inlet opening 68. In this manner, both refrigeration and secondary air curtains are formed across both of the access openings.

If desired, it is possible to join together those portions of secondary air conduits 80 and 82 that extend within partition wall 12 so as to form a single chamber 88. If the secondary air conduits are joined together in this manner so as to form chamber 88 then a single set of fans, such as represented by fan 90, can be used for circulating air through the secondary air conduits.

Figure 8:
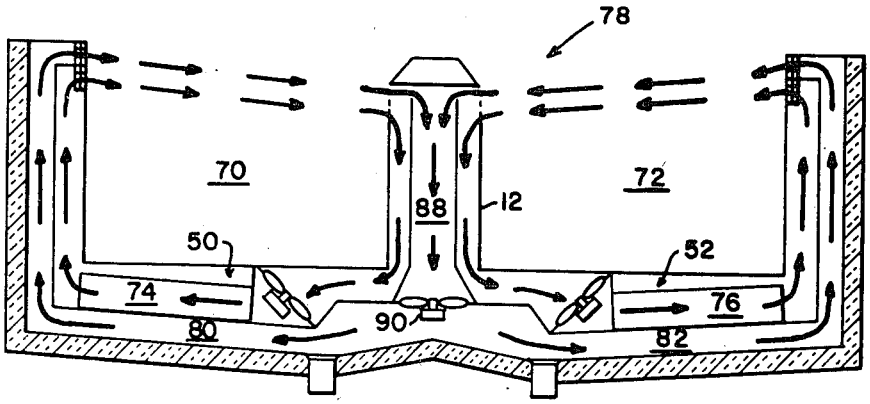
FIG. 8 is a cross-sectional view of another embodiment of a multi-band island refrigerated display case during a refrigeration cycle of operation.

Both embodiments of the multi-band island display case illustrated in FIGS. 7 and 8, are operated for ambient air defrosting by reversing the direction of flow of air through the secondary air conduits alone or in addition by reversing the direction of circulation of air through the refrigeration air conduits. In either procedure of operation, ambient air is caused to flow through the refrigeration air conduits as further explained below. With respect to those embodiments discussed below, each is illustrated as having totally separate secondary air conduits with the conduits having their own set of fans. Those embodiments illustrated below, however, notably the embodiments of FIGS. 9, 10 and 11, can be constructed so as to have a single chamber within the partition wall for the secondary air conduit portion such as shown in FIG. 8 along with a single set of fans such as represented by fan 90.

Figure 9:
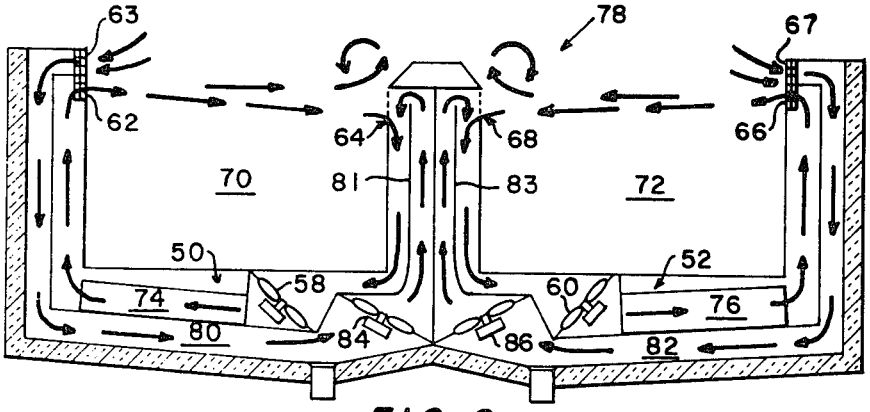
FIG. 9 is a view similar to FIG. 7 with the display case being operated in a defrost cycle of operation.

In FIG. 9, the multi-band island refrigerated display case 78 is shown in a defrost cycle of operation. During the illustrated defrost cycle, the direction of air flow through the secondary air conduits, 80 and 82, is reversed. By reversing the direction of air flow, ambient air is drawn into secondary air conduits 80 and 82 through the respective outlet openings 63 and 67. During this operation, evaporator coils 74 and 76 are deactivated and the direction of air flow through the refrigeration air conduits 50 and 52 is maintained. As the ambient air flows through secondary air conduits 80 and 82, the air passes over the tops of wall members 81 and 83 so as to enter the air flow through the refrigeration air conduits 50 and 52. In this manner, the ambient air drawn into and circulated through secondary air conduits 80 and 82 is then carried into refrigeration air conduits 50 and 52. The ambient air that flows through the refrigeration air conduits serves to defrost any frost buildup within those conduits, in particular the frost buildup on evaporator coils 74 and 76. During this operation, the flow of air across the access opening will be maintained due to the air emitted from outlet opening 62 and 66. Some of this air flow, however, will rise in the area of the partition wall such as shown in FIG. 9. Such a phenomenon exists for several reasons. First, since the air traveling across the access openings is slightly warmer due to the introduction of the ambient air, there is a tendency for the air to rise. Next the absence of the secondary air curtain allows a portion of the air traveling across the access opening to rise. Finally with the additional air being drawn from the secondary air conduits into the refrigeration air conduits over the tops of walls 81 and 83, there is not as large of a drawing force on the air traveling across the access opening for causing it to reenter the air conduits.

Figure 10:
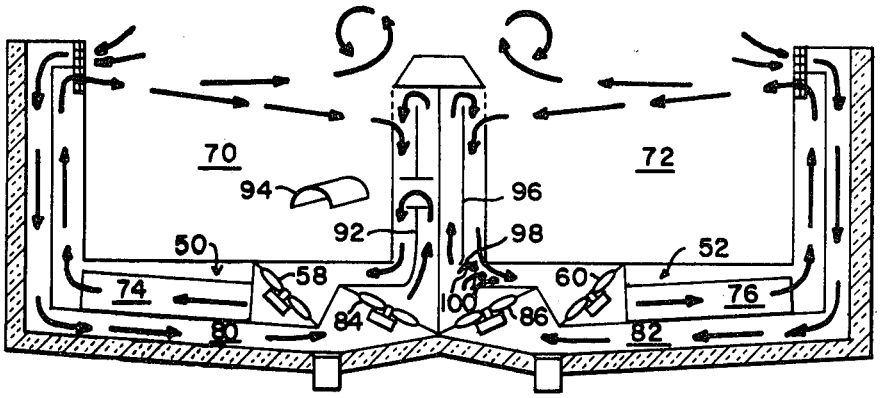
FIG. 10 is a cross-sectional view of a modified embodiment of a multi-band island refrigerated display case during a defrost cycle of operation.

To assist in the transfer of ambient air from secondary air conduits 80 and 82 into refrigeration air conduits 50 and 52, several modifications can be made to the display case such as shown in FIG. 10. Two different possible modifications are shown in the illustrated display case either of which can be utilized. First, at least one opening is made within each of the walls 92 and 96. As shown in connection with the opening in wall 92, an air scoop 94 is mounted for diverting air from secondary air conduit 80 into refrigeration air conduit 50 during a defrost cycle of operation. As air travels along secondary air conduit 80 in the reverse direction of flow, the air will come into contact with air scoop 94 thereby diverting air into refrigeration air conduit 50. In order to divert the ambient air from secondary air conduit 82 into refrigeration air conduit 52, a different embodiment can be alternatively utilized in place of an air scoop as illustrated in FIG. 10. As shown, wall 96 has a plurality of openings, or perforations, 98. Associated with each of the perforations is a corresponding guide fin 100. As the air passes in a reverse direction through secondary air conduit 82, guide fins 100 diverts a portion of such air into refrigeration air conduit 52 where it is then circulated through such conduit.

Figure 11:
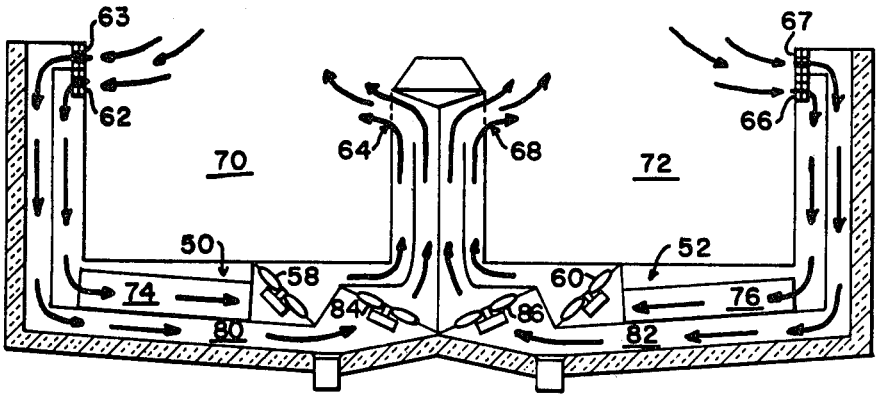
FIG. 11 PRIOR ART
FIG. 11 is a view similar to FIGS. 7 and 9 except for a difference in the operation of the defrost cycle.
Figure 12:
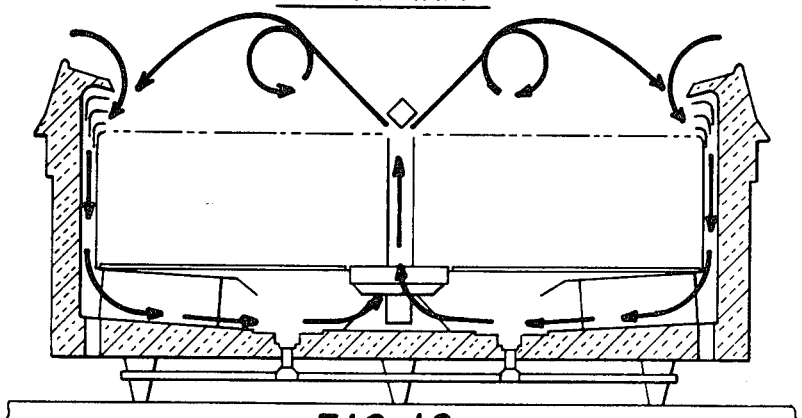
FIG. 12 is a cross-sectional view of a prior art island display case during a defrost cycle of operation.

In another alternative embodiment, instead of maintaining the direction of air flow through refrigeration air conduits 50 and 52 such as discussed above, the direction of air flow through both air conduits can be reversed such as shown by the arrows in FIG. 11. In this manner, ambient air is then drawn into both refrigeration air conduit 50 and secondary air conduit 80 through outlet openings 62 and 63, respectively. Such air is circulated through the conduits and then expelled through inlet opening 64. Similarly ambient air is drawn into refrigeration air conduit 52 and secondary air conduit 82 through outlet openings 66 and 67. After the air passes through refrigeration air conduit 52 and secondary air conduit 82 it is expelled through inlet opening 68. The ambient air passing through the air conduit serves to defrost any frost buildup within the conduits and in particular within the evaporator coils 74 and 76.

In both display cases 48 and 78 the air flow directions during refrigeration and defrost can be reversed such as shown in FIGS. 1 and 2. With such air flow patterns the defrost air can be directed away from the display case such as shown in FIG. 2.

In connection with any of the various embodiments disclosed herein, it is possible to employ a small supplemental electrical heater wire in a position adjacent to the evaporator coils. Such a supplemental heater wire can be utilized for providing a small amount of supplemental heat for defrosting any excess buildup of frost on the evaporator coils. Such a heater wire would not be utilized on a regular basis but normally would be called into operation only when required.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. An island refrigerated display case comprising:

a cabinet having four outer walls and a bottom wall, first and second interior display spaces with a partition wall separating said display spaces, and an access opening associated with each of said display spaces for enabling access to refrigerated products within said display case;

a first refrigeration air conduit extending along one of said outer walls, said bottom wall and said partition wall of said cabinet so as to extend around said first interior display space and having an air inlet opening at one end of the associated said access opening and an air outlet opening at the other end of the associated said access opening, said inlet opening and said outlet opening being aligned so that air leaving said outlet opening is directed across said access opening and received by said inlet opening so as to establish a refrigerated air curtain across said access opening;

a second refrigeration air conduit extending along the opposite of said outer walls, said bottom wall and said partition wall of said cabinet so as to extend around said second interior display space and having an air inlet opening at one end of the associated said access opening and an air outlet opening at the other end of the associated said access opening, said inlet opening and said outlet opening being aligned so that air leaving said outlet opening is directed across said access opening and received by said inlet opening so as to establish a refrigerated air curtain across said access opening;

first and second air circulating means for circulating air through said first refrigeration air conduit and said second refrigeration air conduit, respectively;

first refrigeration means including a first evaporator coils arranged within said first refrigeration air conduit for cooling air flowing through said first refrigeration air conduit during a refrigeration cycle of operation of said display case;

second refrigeration means including a second evaporator coil arranged within said second refrigeration air conduit for cooling air flowing through said second refrigeration air conduit during a refrigeration cycle of operation of said display case;

a first secondary air conduit extending around said first refrigeration air conduit and having an air outlet opening arranged for directing a flow of air across the associated said access opening such as air flow creating a secondary air curtain across said access opening lying outside of the refrigerated air curtain;

a second secondary air conduit extending around said second refrigeration air conduit and having an air outlet opening arranged for directing a flow of air across the associated said access opening, such air flow creating a secondary air curtain across said access opening lying outside of the refrigerated air curtain;

control means for switching said display case between a refrigeration cycle of operation and a defrost cycle of operation and during such defrost cycle of operation temporarily terminating the operation of said refrigeration means and causing ambient air to be drawn into and flow through both said first and second refrigeration air conduits and said first and second secondary air conduits for causing defrosting of any frost buildup within such conduits and said first and second refrigeration means; and, means for causing the ambient air during a defrost cycle of operation to be expelled from each of said refrigeration air conduits so as to flow up and away from said display case along a path flowing over the outside of an outer wall of said cabinet so that such expelled ambient air is prevented from reentering said refrigeration air conduits.

2. An island refrigerated case according to claim 1 wherein both said first and second secondary air conduits extend entirely around their associated said refrigeration air conduits and each of said secondary air conduits has an air inlet opening; the corresponding said air outlet opening and said air inlet opening of each said secondary air conduits being aligned so that air leaving said outlet opening is directed across the associated said access opening and received by said inlet opening and further comprising additional air circulating means for circulating air through said first and second secondary air conduits.

3. An island refrigerated display case according to claim 1 wherein the portions of said first and second secondary air conduits extending within said partition wall are constructed so as to form a single chamber.

4. An island refrigerated display case according to claim 2 wherein during a defrost cycle of operation said control means is operable to cause air flowing through said secondary air conduits to reverse in direction while maintaining the direction of air flow through said refrigeration air conduits.

5. An island refrigerated display case according to claim 4 wherein the associated said refrigeration and secondary air conduits share a common wall member, said common wall member has at least one opening therein so that during a defrost cycle of operation air can flow from said secondary air conduit into said refrigeration air conduit.

6. An island refrigerated display case according to claim 5 further comprising an air scoop arranged within said opening in each of said common wall members for directing air flowing through said secondary air conduit into the associated said refrigeration air conduit during a defrost cycle of operation.

7. An island refrigerated display case according to claim 5 further comprising a guide member associated with each opening in said common wall member for directing air from said secondary air conduit into the associated said refrigeration air conduit during a defrost cycle of operation.

8. An island refrigerated case according to claim 1 or 2 wherein said control means is operable for causing the direction of air flow through both said refrigeration and secondary air conduits to flow in a reverse direction during a defrost cycle of operation.

9. An island refrigerated display case according to claim 1 or 2 wherein during a refrigeration cycle of operation each said first and second air circulating means operate to cause air to flow through the respective said first and second refrigeration air conduit so as to travel across said access opening in a direction flowing from said outer walls towards said partition wall.

10. An island refrigerated display case according to claim 1 or 2 wherein during a refrigeration cycle of operation each of said first and second air circulating means operates to cause air to flow through the respective said first and second refrigeration air conduits so as to travel across said access opening in a direction flowing from said partition wall towards said outer walls.

11. An island refrigerated display case according to claim 10 wherein during a defrost cycle of operation both of said air circulating means cause the air flow through said refrigeration air conduits to flow in a direction opposite the air flow during a refrigeration cycle of operation so that defrost air is emitted from the associated said inlet air opening.

12. An island refrigerated display case according to claim 11 further comprising means for directing air flow out of said air inlet openings during a defrost cycle up and away from said display case.

13. An island refrigerated display case according to claim 1 wherein said first secondary air conduit only extends partially around said first refrigeration conduit and has an air inlet opening arranged within said first refrigeration air conduit so as to receive air flowing through said first refrigeration air conduit before such air passes completely through the respective said evaporator coil; and said second secondary air conduit only extends partially around said second refrigeration air conduit and has an air inlet opening arranged within said second refrigeration air conduit so as to receive air flowing through said second refrigeration air conduit before such air passes completely through the respective said evaporator coil.

14. A method of operating an island refrigerated display case where the display case includes:

a cabinet having bottom and opposing side walls, first and second interior display spaces with a partition wall separating the display spaces and an access opening associated with each of the display spaces for enabling access to products displayed within the display case; first and second inner air conduits respectively extending around the first and second display spaces, with each inner conduit having a first air outlet opening adjacent one end of the respective opening and a first air inlet opening adjacent the other end of the access opening with the first air outlet opening and the first air inlet opening being aligned so that air leaving the first outlet opening is directed towards and received by the first air inlet opening; an evaporator coil arranged within each of the first and second inner air conduits for cooling the air passing therethrough; and first and second outer air conduits respectively extending at least partially around the first and second display spaces, with each being arranged adjacent to the corresponding first and second inner air conduit but outwardly therefrom and each having a second air outlet opening adjacent one end of the respective access openings so that air leaving said second air outlet opening is directed across the access opening; said method comprising the steps of:

circulating air through the first and second inner air conduits so as to establish inner air bands and inner air curtains across the access openings in the cabinet;

cooling air passing through the first and second inner air conduits only during a refrigeration cycle of operation of the display case;

circulating air through the first and second outer air conduits so as to establish outer air bands with outer air curtains across the access openings in the cabinet;

causing ambient air to pass through the inner air conduits during a defrost cycle and ceasing the cooling of the air during such defrost cycle;

reversing the direction of air flow through at least one of the inner and outer air conduits of each set of conduits during a defrost cycle; and, causing the ambient air during a defrost cycle of operation to be expelled from each of the inner air conduits so as to flow up and away from the display case along a path flowing over the outside of an outer wall of said cabinet so that such expelled ambient air is prevented from reentering the inner air conduits.

15. A method according to claim 14 wherein the direction of air flow through each of the outer air conduits is reversed during a defrost cycle; and further comprising the steps of drawing ambient air from outside of the display case into each of the outer air conduits and causing a portion of such ambient air as it flows through such outer air conduit to be diverted into the associated inner air conduit.

16. A method according to claim 14 or 15 wherein the direction of air flow through both of the associated inner and outer air conduits is reversed during a defrost cycle of operation and ambient air from outside of the display case is drawn into both conduits during a defrost cycle of operation.

17. A method according to claim 14 where the first and second outer air conduits extend only partially around the respective display space and each of the outer conduits has an inlet opening arranged so that during a refrigeration cycle of operation such inlet opening receives air passing through the associated inner air conduit before the air has passed through the evaporator coil; said method further comprising the step of:

transferring heat from the ambient air passing through each of the outer air conduits to the air passing through the associated inner air conduit during a defrost cycle of operation by conduction and convection.

18. A method according to claim 17 wherein the volume of air flowing through the outer air conduits during at least a portion of a defrost cycle of operation is greater than the volume of air flowing through the outer air conduits during a refrigeration cycle of operation.

19. A method according to claim 17 wherein the total volume of air flowing through the inner and outer air conduits during a defrost cycle of operation is less than the total volume of air flowing through the inner and outer air conduits during a refrigeration cycle of operation.

20. A method according to claim 17 wherein a portion of the reverse air flow through each of the outer air conduits flows in contact with a portion of the evaporator coil in the associated inner air conduit for defrosting such coil.

* * * * *